US006662958B2

(12) United States Patent
German et al.

(10) Patent No.: US 6,662,958 B2
(45) Date of Patent: Dec. 16, 2003

(54) COMPOSITE CLOSURE HAVING DISK TIGHTENING FEATURE

(75) Inventors: Galen German, Lancaster, OH (US); James L. Martin, Lancaster, OH (US)

(73) Assignee: Crown Cork & Seal Technologies Corporation, Philadelphia, PA (US)

( * ) Notice: Subject to any disclaimer, the term of this patent is extended or adjusted under 35 U.S.C. 154(b) by 0 days.

(21) Appl. No.: 10/062,115

(22) Filed: Jan. 31, 2002

(65) Prior Publication Data

US 2003/0141271 A1 Jul. 31, 2003

(51) Int. Cl.[7] ..... G65D 41/34
(52) U.S. Cl. ..... 215/252; 215/276
(58) Field of Search ..... 215/252, 276, 215/350, 274

(56) References Cited

U.S. PATENT DOCUMENTS 4,679,696 A * 7/1987 Bonnenfant et al. ..... 215/252
4,809,858 A * 3/1989 Ochs ..... 215/276
4,880,127 A * 11/1989 Doi ..... 215/252
5,009,324 A 4/1991 Ochs ..... 215/276
5,031,787 A 7/1991 Ochs ..... 215/276
5,660,290 A * 8/1997 Hayes ..... 215/252
5,685,443 A 11/1997 Taber et al. ..... 215/252
5,809,860 A 9/1998 Haaser ..... 83/880
6,220,466 B1 4/2001 Hayes et al. ..... 215/276
6,276,543 B1 * 8/2001 German et al. ..... 215/252

* cited by examiner

*Primary Examiner*—Lee Young
*Assistant Examiner*—James Smalley
(74) *Attorney, Agent, or Firm*—Woodcock Washburn LLP

(57) ABSTRACT

A composite closure includes a band and an insert disk. A contact surface urges downwardly against the disk even while the band moves longitudinally relative to the disk or container. The closure has a fully tightened position in which the band's ring contacts the disk's annular channel, a loose position in which the ring is spaced apart from the annular channel, and an intermediate tightened position in which the ring is spaced apart from the disk and in which the contact surface urges against the curl. A retaining feature, which presses upwardly against the disk during the opening process, defines a gap in which the disk curl is disposed.

47 Claims, 3 Drawing Sheets

COMPOSITE CLOSURE HAVING DISK TIGHTENING FEATURE

BACKGROUND

Composite closures typically include a metal insert disk and a plastic band. The disk often includes a channel for receiving a rim of the container and the band often includes a threaded skirt and a ring that extends inwardly from a top portion of the skirt. A sealant may be disposed between the container rim and the channel to enhance the seal therebetween. U.S. Pat. No. 5,685,443, entitled "Composite Closure And Method Of Making Same;" 6,220,466, entitled Composite Closure, Method For Assembling It And Method For Closing A Container With It;" and 5,031,787, entitled "Low Height Floating Disk Closure," each of which is incorporated herein by reference in its entirety, generally disclose examples of composite closures.

Often, composite closures include a floating disk such that the band is capable of longitudinal movement relative to the insert disk. A tamper evident band may depend from the bottom of the skirt, and a bead may be disposed on an interior of the skirt to urge against a periphery of the disk to separate the insert disk from the container rim during the opening process. Floating disk closures are often configured for sequential opening such that, during the initial opening process, the tamper evident band fractures before the bead urges upwardly against a periphery of the disk to break the vacuum seal.

There is a general goal in the packaging industry for improved composite closures.

SUMMARY

A composite closure for coupling with a container is provided that includes an insert disk and a band. The insert disk includes a curl formed at a periphery thereof The disk includes an annular skirt, a retaining feature, a ring, and a contact surface. The skirt includes threads formed on an interior surface thereof The retaining feature extends radially inwardly from the skirt. The ring extends radially inwardly from an upper portion of the skirt over the disk. The contact surface extends inwardly from the skirt such that the contact surface and the retaining feature form a recess therebetween for receiving the disk curl. The contact surface urges downwardly against the disk curl while the closure is screwed onto its corresponding container.

Preferably, the closure has a fully tightened position in which the ring contacts the disk, a loose position in which the ring is spaced apart from the disk, and an intermediate tightened position in which the ring is spaced apart from the disk and in which the contact surface urges against the curl. The intermediate tightened position is between the fully tightened position and the loose position. Preferably, the contact surface of the band exerts positive sealing force downwardly onto the disk upon initial opening of the closure—even while the ring is spaced apart from or stops urging against the disk during the initial stage of the opening process. Exerting such downward force on the disk inhibits tampering with the container package during the initial stage of the opening process before a frangible tamper evident band fractures (or suitable other type of tamper evident band indicates opening). A closure and container combination is also disclosed.

DESCRIPTION OF PREFERRED EMBODIMENTS

Figure 1:
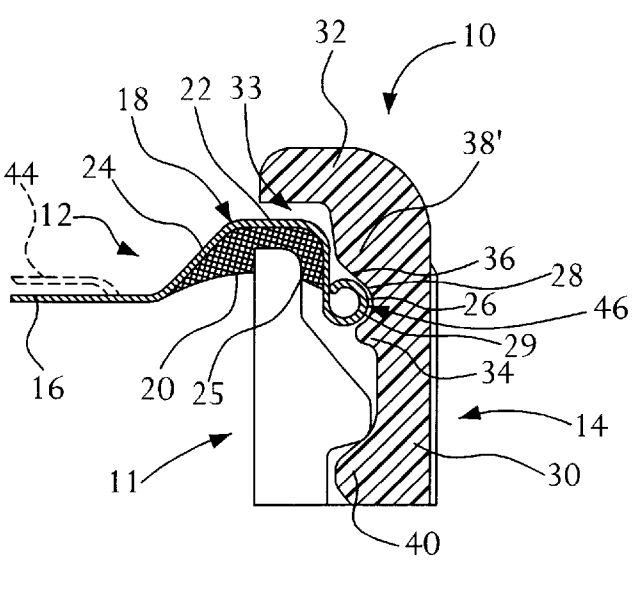
FIG. 1 is a partial longitudinal cross sectional view of a closure and container assembly in a loose position.

As shown in FIG. 1, a closure and container combination includes a composite closure 10 and a corresponding container 11. Closure 10 includes an insert disk 12 and circumferential band 14. Preferably, insert disk 12 is formed of a metal and band 14 is formed of a plastic, as will be understood by persons familiar with composite closure technology, and the present invention encompasses any suitable materials.

Disk 12 includes a center portion 16 and an annular channel 18 disposed circumferentially about center portion 16. A tamper indicating button 44 is shown in dashed lines in FIGS. 1 and 7 to indicate that it is optional. Channel 18, which is substantially downward-facing, is formed by an inboard wall 24 and an outboard wall 25 with a top surface 22 formed therebetween. Preferably, channel top surface 22 forms a substantially flat top surface. A sealant 20, such as plastisol or other conventional material, may be disposed in the channel. Channel inboard wall 24 is shown having a sloped profile, in cross section, and channel outboard wall 25 is shown having a substantially vertical profile, although the present invention encompasses disks having any configurations.

A curl 26 is formed at the lower end of channel outboard wall 25, and preferably extends radially outwardly. As shown in the figures, curl 26 includes an upper surface 28 and a lower surface 29. Preferably, the cut edge is curved generally radially outwardly at the bottom portion of channel outer wall 25 and then curves radially inwardly such that the cut edge is not exposed and such that curl 26 is circular or rounded in longitudinal cross section. Thus, upper and lower surfaces 28 and 29 are defined, in longitudinal cross section and as shown in the figures, by approximately ninety degrees of a circle above and below, respectively, a horizontal line (not identified in the figures). The present invention is not limited to the configuration of curl 26, upper surface 28, and lower surface 29 shown in the figures, but rather encompasses any configuration that provides a surface against which retaining bead 34 or like structure may act, as explained more fully below.

Band 14 includes an annular skirt 30 and a ring 32 extending radially inwardly from an upper portion of skirt 30. Threads 40 extend radially inwardly from an interior portion of skirt 30. Depending on the position of band 14 relative to container 11 and disk 12, the underside of ring 32 and disk top surface 22 may be spaced apart to form a gap 33. Above threads 40, a retaining feature, such as bead 34, extends substantially radially inwardly from skirt 30. Alternatively, retaining bead 34 may be omitted and the closure may be configured such that a top portion 40' of the closure threads may perform the function of the retaining bead, as shown schematically in dashed lines in FIG. 8. In this regard, the term "retaining feature" encompasses retaining bead 34, closure thread top portion 40', and any other structure that performs the retaining function and/or opening function. Above retaining bead 34 (or alternatively, thread top portion 40'), a contact structure, which is generally referred to herein by reference numeral 38 (which encompasses reference numerals 38' and 38", as described below), extends radially inwardly from skirt 30, and preferably is integrally coupled to ring 32.

Figure 6:
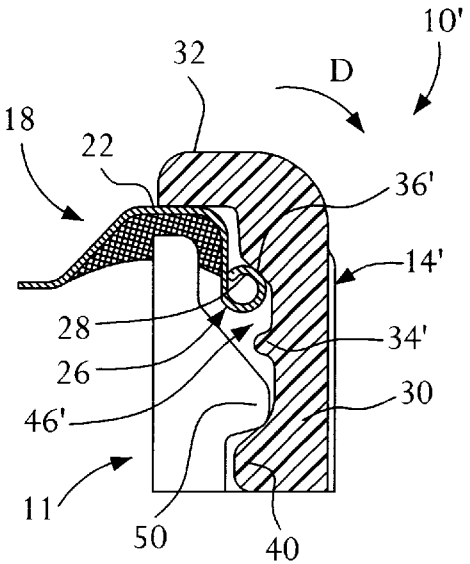
FIG. 6 is a partial longitudinal cross sectional view of the closure and container shown in FIG. 4 in a fully tightened position.
Figure 7:
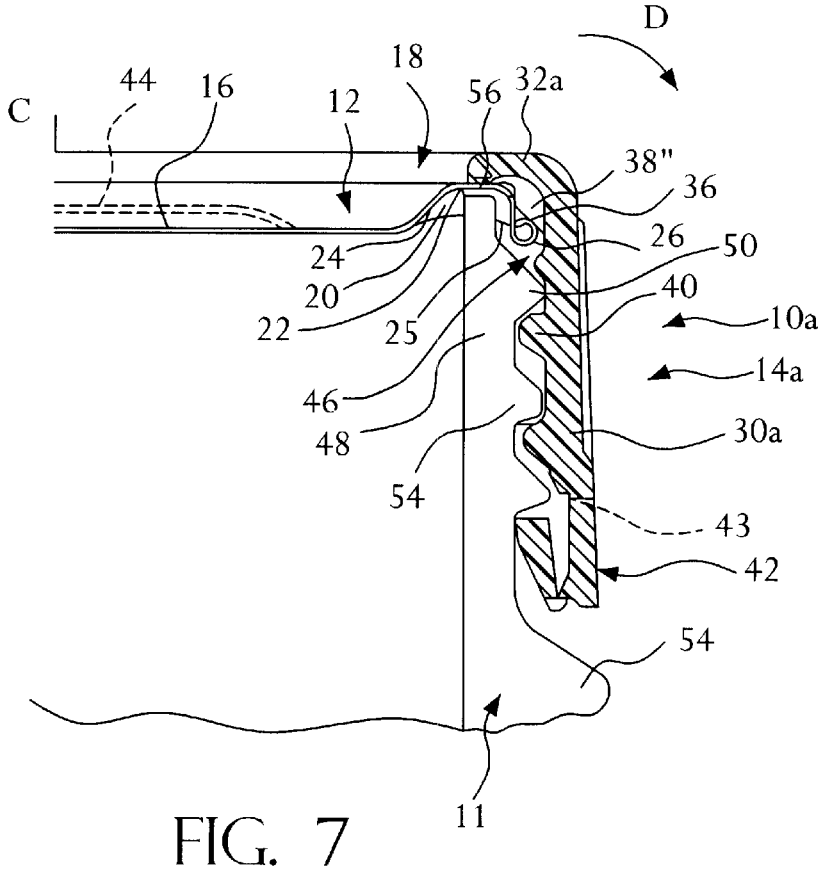
FIG. 7 is an enlarged partial longitudinal cross sectional view illustrating additional features encompassed by the present invention.

Contact structure 38 may be a formed by a circumferentially continuous bead, which is referred to herein by reference numeral 38' and is shown in longitudinal cross section in FIGS. 1 through 6, a circumferentially discontinuous bead that is formed by arcuate segments, or circumferentially distributed gussets, which will be referred to herein by reference numeral 38" and are shown in FIGS. 7 though 9. Reference numeral 38 refers to any structure, including but not limited any of the structures described herein, that form a contact surface 36 which includes a surface that is angled or oblique relative to a longitudinal centerline C, which is best shown in FIG. 8, in longitudinal cross section.

Figure 8:
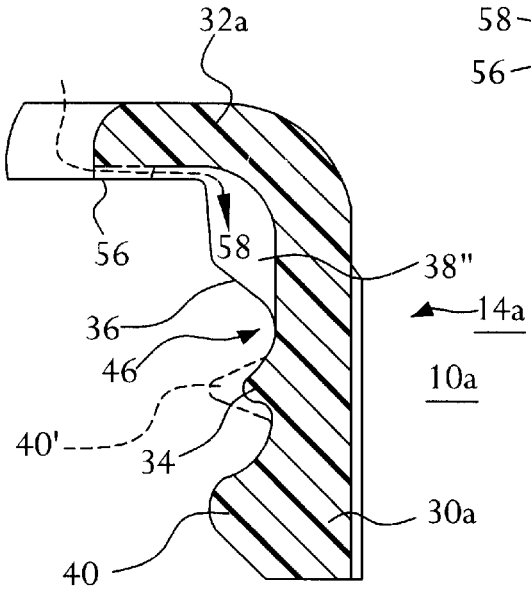
FIG. 8 is an enlarge cross sectional view of a portion of the closure shown in FIG. 7.
Figure 9:
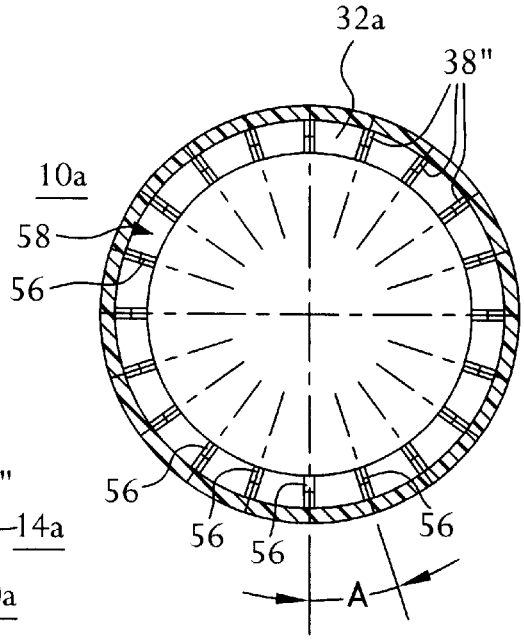
FIG. 9 is a transverse cross sectional view of an embodiment of the present invention.

FIGS. 7 and 8 show a longitudinal cross sectional view of a closure, which is indicated by reference numeral 10*a*, that is formed with gussets 38". Closure 10*a* includes a band 14*a*, a skirt 30*a*, and a ring 32*a*. As best shown in FIG. 9, from which portions of closure 10*a* have been removed for clarity, gussets 38" preferably are equidistantly spaced around an upper portion of the interior of skirt 30*a* and are oriented radially. Pads 56 depend downwardly from the underside of ring 32*a*. Pads 56 preferably are continuous with gussets 38" such that passages 58 are formed between adjacent pads 56 and gussets 38", thereby enabling communication between ring 32 and disk 12. Passages 58 thus may expose the area around the area of the curl 26 and gap 46 even while the closure 10*a* is in its fully tightened position. Like passages may be formed by discontinuities in bead 38'(not shown).

As shown in the Figures, bead 38' and gusset 38" preferably are integrally formed with skirt 30 or 30*a* and ring 32 or 32*a*. Thus, an upper portion of bead 38' or gusset 38" merges into the underside of ring 32 or 32*a*, and a radially outboard portion of bead 38' or gusset 38" merges into skirt 30 or 30*a*. Bead 38' or gusset 38" thereby stiffen ring 32 or 32*a* relative to skirt 30, and may diminish the magnitude of deflection of the closure upon tightening, as described more fully below. In this regard, bead 38' and gussets 38" form stiffeners. Contact surface 36, as shown in the Figures, is preferably adjacent to skirt 30 and is spaced apart from ring 32 by a substantially vertical section (in longitudinal cross section), although the present invention encompasses any cross sectional configuration of bead 38' and gussets 38".

Figure 3:
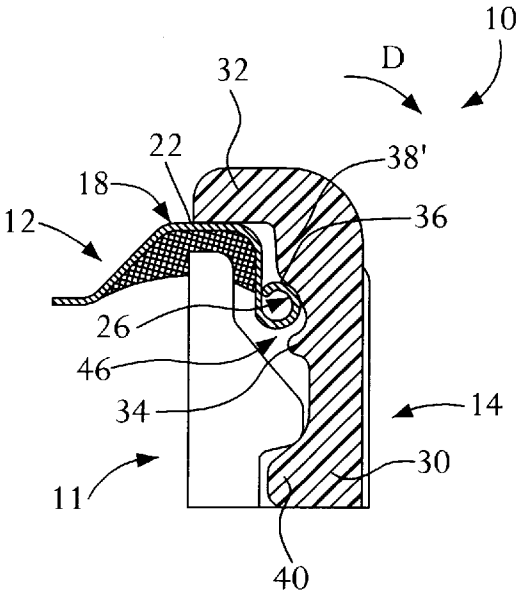
FIG. 3 is a partial longitudinal cross sectional view of the closure and container shown in FIG. 1 in a fully tightened position.
Figure 2:
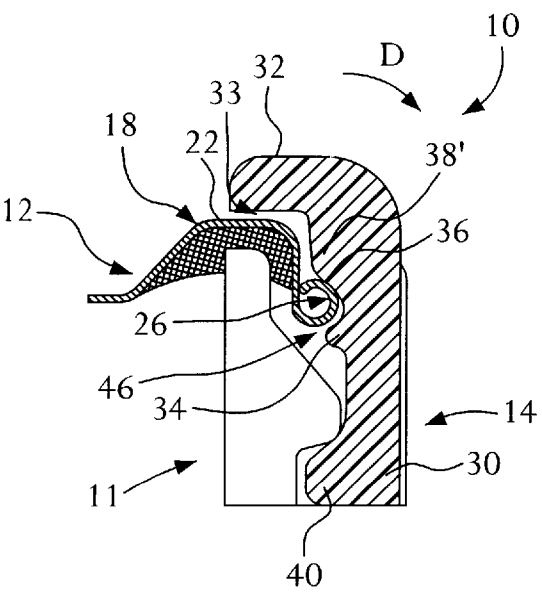
FIG. 2 is a partial longitudinal cross sectional view of the closure and container shown in FIG. 1 in an intermediate position.

Contact surface 36 is longitudinally spaced apart from retaining bead 34 (or thread top portion 40' ) so as to form a gap 46 therebetween. As shown in FIGS. 1 through 3, illustrating an embodiment of the closure according to an aspect of the present invention, retaining bead 34 and contact surface 36 are spaced apart such that curl 26 is moveable between bead 34 and surface 36 only by a small amount, thereby enabling sequential opening. Alternatively, bead 34 and contact surface 36 may be spaced apart by a dimension such that bead 34 and contact surface 36 are in simultaneous contact with curl 26. Thus, contact surface 36 would contact curl upper surface 28 while bead 34 contacts curl lower surface 29. The present description employs the embodiment that includes retaining bead 34 to illustrate gap 46. The present invention, however, is not limited to such an embodiment, but rather includes any structure that is capable of retaining disk 12, including the embodiment employing thread top portion 40' for contacting curl lower surface 29. In this regard, FIG. 8 schematically shows thread top portion 40' in phantom to indicate that thread top portion 40', rather than (or in combination with a bead) may contact curl 26.

Figure 5:
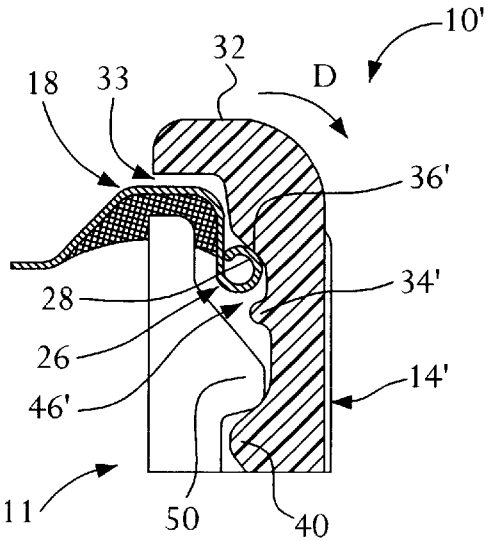
FIG. 5 is a partial longitudinal cross sectional view of the closure and container shown in FIG. 4 in an intermediate position.
Figure 4:
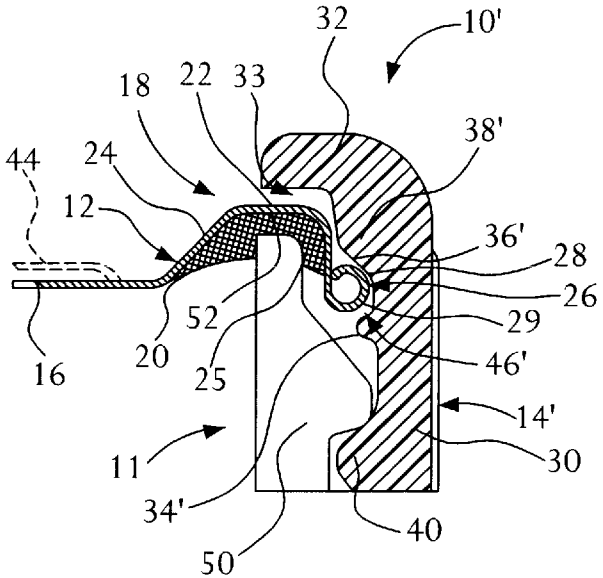
FIG. 4 is a partial longitudinal cross sectional view illustrating another embodiment of a closure and container assembly.

As shown in FIGS. 4 through 6, illustrating another embodiment of an aspect of the present invention, a closure 10' includes a metal disk 12, which is identical to the disk described above with respect to the first embodiment, and a band 14'. Band 14' includes all of the components of band 14 as described above, but a retaining bead 34' is spaced apart from a contact surface 36' to form a gap 46' therebetween. Alternatively, gap 46' may be formed by closure thread top portion 40' (not shown in FIGS. 4 through 6), as described above. Gap 46' has a longitudinal dimension that enables curl 26 to float between band 14' and contact surface 36', as described more fully below. FIGS. 4 through 6 employ a bead 38' to illustrate the gap 46', although gap 46' may be employed with gussets 38", as will be clear to persons familiar with closure technology in view of the present disclosure.

Container 11, with which closure 10, 10', and/or 10' may be coupled, includes a neck 48 having threads 50 and forming a rim 52. As in conventional closures and containers, rim 52 protrudes into channel 18 such that sealant 20 is deformed to enhance a seal between disk 12 and container 11. As shown in FIG. 7, a tamper evident bead or lug 54 may protrude outwardly from neck 48 below threads 50 to cooperate with a tamper evident band 42 that is coupled at frangible connection 43 to a lower portion of skirt 30. FIG. 7 illustrates tamper evident band 42 and schematically shows connection 43. As is common in many container and closure packages, connection 43 fractures in response to initial rotation of the closure to indicate that the seal on the package has been broken.

Contact surface 36 or 36' is angled downwardly to urge downwardly onto curl 26 even while maintaining the capability of disk 12 to float or slide relative to band 14 or 14'. Thus, contact surface 36 or 36' may form a right circular cone or any other shape that forms a surface on which curl 26 is capable of riding, and encompasses surfaces having a stepped cross sectional profile that changes slope (not shown). The present invention encompasses a contact surface (not shown) that is substantially horizontal (that is, perpendicular to longitudinal axis C), and/or encompasses a peripheral portion of a disk (not shown) having a non-curled periphery, which may be oblique to longitudinal axis C and/or may be flexible.

The following description of loose, intermediate, and tightened positions employs the configuration that employs continuous bead 38, and omits particular reference to the configuration that employs gussets 38" for convenience and brevity. The following description is, of course, equally applicable to configurations employing gussets 38"(that is, to closure 10*a*). FIGS. 1 and 4 illustrate band 14 and 14', respectively, in a loose position (or a plurality of positions) such that band 14 or 14' is threaded onto container 11 at a position in which band 14 or 14' does not exert any upward or downward force on disk 12. The loose position shown in FIGS. 1 and 4 may be encountered, for example, during the initial capping process after disk 12 has been installed onto container 11, or during the initial opening process (that is, the first time the factory seal between container 11 and disk 12 is to be broken) or subsequent opening processes.

FIGS. 2 and 5 illustrate an intermediate position of closure 10 and 10', respectively, which is obtained by screwing or tightening closure 10 or 10' onto container 11 from the loose position shown in FIGS. 1 and 4. In the loose position, the underside of ring 32 is spaced apart from the top surface 22 to form gap 33 therebetween. Gap 33 preferably exists in the intermediate position with a smaller magnitude than that in the loose position. In the intermediate position, even though ring 32 is spaced apart from the top surface 22 of disk 12, band 14 or 14' urges disk 12 downwardly against container rim 52 because contact surface 36 or 36' urges downwardly on curl 26. Upon further tightening of closure 10 or 10', curl 26 may slide relatively upwards on contact surface 36 or 36' until ring 32 contacts disk top surface 22. Upon subsequent tightening past the intermediate position, a closure 10 or 10' eventually reaches a fully tightened position, which is shown in FIGS. 3 and 6. In the fully tightened position, preferably both the ring 32 and contact surface 36 or 36' urge downwardly on disk 12, that is, via disk top surface 22 and curl upper surface 28, respectively.

The term "intermediate position" is employed herein to indicate the position of curl 26 relative to contact surface 36 or 36', and encompasses any position between the loose position and the fully tightened position. Similarly, the term "fully tightened position" is employed herein to indicate an intended or predetermined position, although ring 32 may contact disk top surface 22 prior to the closure achieving the fully tightened position and the closure may be tightened beyond the position at which ring 32 contacts disk top surface 22. Further, the present invention encompasses any configuration of bands, including those, for example, that lack a ring. In the figures, contact surface 36 or 36' maintains contact with curl 26 between the intermediate and fully tightened positions, but the present invention is not limited to such structure. Rather, the present invention encompasses any structure that releases its downward force component during any stage of the tightening and/or loosening process.

During the initial opening process, a user may unscrew closure 10 or 10' relative to container 11 to urge ring 32 upward relative to rim 52. In the opening process, even while ring 32 stops providing an effective downward force on disk 12, contact surface 36 or 36' urges downwardly against curl upper surface 28, thereby promoting contact of disk 12 with container 11. For closures that include tamper evident bands 42, contact surface 36 or 36' may maintain contact with curl upper surface 28 until tamper evident band connection 43 is fractured, thereby enhancing tamper indicating features of the package. Preferably, closures 10 and 10' undergo sequential opening such that after connection 43 is fractured, retaining bead 34 (or thread top portion 40') urges against curl 26 to lift disk 12 from container neck 48.

Ring 32 may have a tendency to expand radially outwardly in response to tightening of band 14 or 14' as contact surface 36 or 36' urges against curl upper surface 28 with a force that has both longitudinal and radial components. Radial outward expansion of ring 32 is indicated by the directional arrow D, which is shown as curved to indicate that band 14 or 14' pivots outwardly as it is drawn down relative to container 11. Stiffeners 38' and/or 38" stiffen ring 32 and/or **32*a* and may inhibit gap formation between the inboard edge of ring 32 and/or 32*a* and channel top surface 22**. The present invention is not limited to closures employing such stiffeners, but rather encompasses closures that lack any stiffening means.

Typically, because curl 26 is relatively inelastic compared to band 14 or 14', curl 26 will deflect or deform much less than band 14 or 14'. The present invention is not limited to such a configuration, but rather encompasses composite closures (not shown in the Figures) in which the peripheral edge or curl of the closure deflects more than that shown in the figures. In such a configuration, the contact surface on the skirt may be reconfigured to cooperate with such closure edge deflection. In this regard, the present invention encompasses that the peripheral edge or curl may not slide on the closure skirt.

Securing the contents within a container and providing indication of tampering have been a goal of composite closure design. For some prior art closures, it may be possible to partially unscrew a conventional band to provide sufficient space between the conventional closure ring and the insert disk (that is, the space that corresponds to gap 33 in the present closure) to enable rupture of the seal between the disk and the container, yet such unscrewing may be not be enough to fracture the TE band connection. For example, a person seeking to tamper with the contents within a container may, especially in the presence of elevated temperature to soften the plastic of a prior art closure and/or container, unscrew the closure enough such that the tamper evident band does not fracture, but such that the ring is spaced apart from the disk. Thus, the disk may be separated from the container, by (for example) squeezing the container, to enable tampering, even though the tamper evident band does not indicate that the closure had been opened. Separating the disk in this manner may be especially feasible for plastic hot fill or retort containers, which generally have a lower internal negative pressure, although the lack of certainty in the tamper evidence is problematic for all closures, including closures that lack a tamper indicating button 44, which is a common configuration for hot-fill applications employing a container formed of plastic, as well as other applications.

The possibility for a person to defeat a prior art tamper evident system, as described above, may in principle be overcome by configuring a closure such that the tamper evident band fits snugly against the tamper evident bead or lug on the container neck, thereby causing the tamper evident band to fracture upon initial backing off of the closure from its fully tightened position. It is difficult for a closure (having any particular closure dimensions), however, to fit snugly against all tamper evident beads or lugs in all circumstances. For example, variations among filling facilities, capping machinery vendors, machinery torque and/or number of turn settings, and like parameters make it difficult or impractical in a high-speed, industrial context to repeatably and accurately install the closure in a position that always prohibits the above described possibility of tampering.

This problem of the prior art is provided to illustrate a drawback that is substantially overcome by aspects of the present invention. As will be clear to persons familiar with prior art closures in light of the present disclosure, the present invention is applicable in circumstances in which the problems described herein are not present. Thus, the present invention is not limited to solving the particular prior artproblems or drawbacks described herein, but rather encompasses any closure that exhibits the structure or characteristics, and any variations or equivalents thereof, in general accordance with the present disclosure.

The figures illustrate particular embodiments of the present invention, and the invention is not limited to the particular embodiments shown and described herein. For example, it is obvious that gussets 38" may be employed with a gap 46' that enables longitudinal translation or floating between gussets 38" and retaining bead 34'. Further, the present invention is not limited by particular dimensions, materials, and shapes or orientations of components (including contact surfaces), but rather broadly encompasses any such parameters with respect to the claims, as will be understood by persons familiar with closure technology in view of the present disclosure.

We claim:

1. A composite closure for coupling with a container, comprising:

a circular insert disk including a curl formed at a periphery thereof; and a band including:

an annular skirt including threads formed on an interior surface thereof;

a retaining feature extending radially inwardly from the skirt;

a ring extending radially inwardly from an upper portion of the skirt over at least a portion of the disk; and a contact surface extending inwardly from the skirt, the contact surface and the retaining feature forming a recess therebetween for receiving the disk curl, the contact surface spaced apart from a lower surface of the ring and being nonparallel, in longitudinal cross section, to a closure longitudinal axis;

the closure having a fully tightened position in which the ring contacts the disk, a loose position in which the ring is spaced apart from the disk, and an intermediate tightened position in which the ring is spaced apart from the disk and in which the contact surface urges against the curl, the intermediate tightened position being between the fully tightened position and the loose position.

2. The composite closure of claim 1 further comprising a tamper evident band coupled to a lower portion of the skirt, the tamper evident band fracturing in response to untwisting the closure from its fully tightened position while the contact surface is engaged with and urging the curl, whereby the contact surface exerts a downward force on the disk while the tamper evident band is being fractured.

3. The composite closure of claim 2 wherein the contact surface urges downwardly against the curl during the untwisting process until after the tamper evident band is fractured.

4. The composite closure of claim 2 wherein the retaining feature urges upwardly against a lower surface of the curl in response to untwisting the closure relative past the loose position.

5. The composite closure of claim 1 wherein the disk includes an annular channel formed therein, the ring extending radially inwardly over at least a portion of the annular channel, the ring contacting the annular channel in fully tightened position, the ring being spaced apart from the annular channel in the loose position.

6. The composite closure of claim 5 further comprising a sealant disposed in the annular channel.

7. The composite closure of claim 1 wherein the contact surface is oblique, in longitudinal cross section, relative to the closure longitudinal axis.

8. The composite closure of claim 1 wherein the retaining feature is a retaining bead disposed above the closure threads.

9. The composite closure of claim 1 wherein the retaining feature is a top portion of the closure threads.

10. The composite closure of claim 1 wherein the contact surface defines a diameter at an upper portion of the contact surface that is smaller than a diameter at a lower portion of the contact surface, whereby the curl slides on the contact surface in response to longitudinal movement of the closure relative to the disk.

11. The composite closure of claim 10 further comprising a stiffener coupled between the skirt and the ring, the stiffener resisting deformation of the ring relative to the longitudinal centerline in response to tightening of the closure.

12. The composite closure of claim 11 wherein the contact surface is formed on the stiffener.

13. The composite closure of claim 12 wherein the contact surface is a circumferential bead.

14. The composite closure of claim 13 wherein the stiffener is a plurality of gussets.

15. The composite closure of claim 14 wherein the gussets form a passage beneath the ring and into the area proximate the curl.

16. The composite closure of claim 1 wherein the contact surface urges against the curl to secure the disk to the container while the closure is in the intermediate tightened position.

17. The composite closure of claim 1 wherein the contact surface is formed by a continuous bead defining the substantially oblique cross section.

18. The composite closure of claim 1 wherein the contact surface is formed by plural gussets circumferentially disposed about the ring.

19. The composite closure of claim 18 wherein the gussets are oriented substantially vertically.

20. The composite closure of claim 1 wherein the contact surface defines a dimension that diminishes as the band is tightened.

21. The composite closure of claim 1 wherein the contact surface exerts a force on the curl that includes a downward, longitudinal component and an inward, radial component.

22. The composite closure of claim 1 wherein the disk is longitudinally moveable within the recess between the retaining feature and the contact surface.

23. The composite closure of claim 1 wherein the band is integrally formed of a material comprising a plastic.

24. The composite closure of claim 1 wherein the disk is formed of a material comprising a metal.

25. A composite closure for coupling with a container, comprising:

a circular insert disk including a periphery thereof; and a band including:

an annular skirt including threads formed on an interior surface thereof;

a retaining feature extending radially inwardly from the skirt;

a ring extending radially inwardly from an upper portion of the skirt over at least a portion of the disk; and a contact surface extending inwardly from the skirt, the contact surface and the retaining feature forming a recess therebetween for receiving the disk periphery, the contact surface spaced apart from a lower surface of the ring and being non-parallel, in longitudinal cross section, to a closure longitudinal axis;

the closure having a fully tightened position in which the ring contacts the disk, a loose position in which the ring is spaced apart from the disk, and an intermediate tightened position in which the ring is spaced apart from the disk, the intermediate tightened position being between the fully tightened position and the loose position, the contact surface urging against the disk periphery to urge the disk downwardly while the closure is in the fully tightened position and in the intermediate position.

26. The composite closure of claim 25 further comprising a tamper evident band coupled to a lower portion of the skirt, the tamper evident band fracturing in response to untwisting the closure from its fully tightened position while the contact surface is engaged with and urging the disk periphery, whereby the contact surface exerts a downward force on the disk while the tamper evident band is being fractured.

27. The composite closure of claim 26 wherein contact surface urges downwardly against the disk periphery during the untwisting process until after the tamper evident band is fractured.

28. The composite closure of claim 26 wherein the retaining feature urges upwardly against a lower surface of the disk periphery in response to untwisting the closure relative past the loose position.

29. The composite closure of claim 25 wherein the contact surface is oblique, in longitudinal cross section, relative to the closure longitudinal axis.

30. The composite closure of claim 1 wherein the retaining feature is a retaining bead disposed above the closure threads.

31. The composite closure of claim 1 wherein the retaining feature is a top portion of the closure threads.

32. The composite closure of claim 25 wherein the contact surface defines a diameter at an upper portion of the contact surface that is smaller than a diameter at a lower portion of the contact surface, whereby the disk periphery slides on the contact surface in response to longitudinal movement of the closure relative to the disk.

33. The composite closure of claim 32 further comprising a stiffener coupled between the skirt and the ring, the stiffener resisting deformation of the ring relative to the longitudinal centerline in response to tightening of the closure.

34. The composite closure of claim 33 wherein the contact surface is formed on the stiffener.

35. The composite closure of claim 34 wherein the contact surface is a circumferential bead.

36. The composite closure of claim 35 wherein the stiffener is a plurality of gussets.

37. The composite closure of claim 36 wherein the gussets form a passage beneath the ring and into the area proximate the disk periphery.

38. The composite closure of claim 25 wherein the contact surface urges against the disk periphery to secure the disk to the container while the closure is in the intermediate tightened position.

39. The composite closure of claim 25 wherein the contact surface is formed by a continuous bead defining the substantially oblique cross section.

40. The composite closure of claim 25 wherein the contact surface is formed by plural gussets circumferentially disposed about the ring.

41. The composite closure of claim 40 wherein the gussets are oriented substantially vertically.

42. The composite closure of claim 25 wherein the contact surface defines a dimension that diminishes as the band is tightened.

43. The composite closure of claim 25 wherein the contact surface exerts a force on the curl that includes a downward, longitudinal component and an inward, radial component.

44. The composite closure of claim 25 wherein the disk is longitudinally moveable within the recess between the retaining feature and the contact surface.

45. The composite closure of claim 25 wherein the band is integrally formed of a material comprising a plastic.

46. The composite closure of claim 25 wherein the disk is formed of a material comprising a metal.

47. A composite closure and container combination comprising:

a container including a neck that includes threads and a rim form thereon;

a circular insert disk including an annular channel and a curl formed at a periphery thereof, the disk disposed over the container rim for forming a seal therewith; and a band including:

an annular skirt including threads formed on an interior surface thereof and engaged to the container threads;

a retaining feature extending radially inwardly from the skirt;

a ring extending radially inwardly from an upper portion of the skirt over at least a portion of the disk annular channel; and a contact surface extending inwardly from the skirt, the contact surface and the retaining feature forming a recess therebetween for receiving the disk curl, the contact surface spaced apart from a lower surface of the ring and being substantially oblique, in longitudinal cross section, relative to a closure longitudinal axis;

the closure having a fully tightened position in which the ring contacts the annular channel to urge the disk against the container rim, a loose position in which the ring is spaced apart from the annular channel, and an intermediate tightened position in which the ring is spaced apart from the disk and in which the contact surface urges against the curl to urge the disk against the container rim, the intermediate tightened position being between the fully tightened position and the loose position.

* * * * *